United States Patent [19]

A'Costa

[11] Patent Number: 4,570,529

[45] Date of Patent: Feb. 18, 1986

[54] FLASH SUPPRESSOR FOR FIREARMS HAVING RIFLED BARRELS

[76] Inventor: Anthony A'Costa, P.O. Box 5806, Pueblo, Colo. 81002

[21] Appl. No.: 613,180

[22] Filed: May 23, 1984

Related U.S. Application Data

[63] Continuation-in-part of Ser. No. 404,938, Aug. 3, 1982, abandoned.

[51] Int. Cl.[4] ..... F41C 21/18
[52] U.S. Cl. ..... 89/14.2
[58] Field of Search ..... 89/14.2

[56] References Cited

U.S. PATENT DOCUMENTS

| | | | |
|---|---|---|---|
| 1,538,243 | 5/1925 | Gorton | 89/14.2 |
| 2,807,112 | 9/1957 | Garand | 89/14.2 |
| 3,715,955 | 2/1973 | Folley et al. | 89/14.2 |

FOREIGN PATENT DOCUMENTS

| | | | |
|---|---|---|---|
| 111053 | 7/1940 | Australia | 89/14.2 |
| 633617 | 6/1963 | Belgium | 89/14.2 |

*Primary Examiner*—Stephen C. Bentley
*Attorney, Agent, or Firm*—Harold H. Dutton, Jr.

[57] ABSTRACT

A flash suppressor for use on a rifled barrel of a firearm comprising a generally tubular body member having a first portion adapted to receive a projectile from the barrel and a second portion adapted to receive a projectile from the first portion, the first portion having a longitudinal smoothbore passage therethrough, through which a projectile discharged from the barrel passes, the barrel and the first and second portions being coaxial, and the smoothbore passage having a diameter less than the diameter of a circle passing through the bottom of the rifling grooves in the barrel, the second portion having an inside diameter significantly greater than the diameter of the smoothbore passage, and a plurality of radially directed vent openings formed in the second portion of the body member.

14 Claims, 9 Drawing Figures

FLASH SUPPRESSOR FOR FIREARMS HAVING RIFLED BARRELS

CROSS REFERENCE TO RELATED APPLICATION

This application is a continuation-in-part of my copending application Ser. No. 404,938 filed Aug. 3, 1982, now abandoned.

This invention relates to a flash suppressor for firearms. More particularly, this invention relates to a flash suppressor for use by attachment to the muzzle end of a variety of rifles of different calibers, as well as larger weapons including cannons and the like and pistols as well.

BACKGROUND AND OBJECTS OF THE INVENTION

In the prior art, many different types of devices have been proposed for attachment to the end of the barrels of firearms for accomplishing various purposes. Most notably, such attachments have been for the purpose of silencing the noise produced by the firing of the gun or for reducing the recoil of the gun. Some such attachments have been proposed for stabilizing the flight of the projectile. A few such attachments have been proposed for reducing the flash emitted from the end of the barrel when the gun is fired.

For example, U.S. Pat. Nos. 587,802 to Durnford; 323,303 to Fosberry; and 37,193 to Alsop disclose attachments for shotgun type barrels for stabilizing a signal projectile with such guns.

So-called silencers are well known, and usually comprise an attachment having a series of baffles which are designed to reduce the noise.

U.S. Pat. No. 32,685 to DeBrame discloses a gun barrel design which utilizes a so-called "skeleton barrel" whereby the barrel has a number of longitudinally extending slots formed therein. The slots are either straight, in the case of unrifled barrels, or spiraled in the case of a rifled barrel. The purpose of these slots is to reduce the amount of metal which can contact the projectile in order to reduce the friction on the projectile and thereby improve the ballistic characteristics of the projectile, namely the force and distance of the projectile.

However, these prior art patents are primarily intended for use with firearms using black powder, rather than modern smokeless powder, and the difference in the type of powder used is significant, and well known. Black powder produces an "explosion" and produces a high amount of smoke upon firing the gun, and additionally leaves a significant residue on the barrel of the gun, and has a much lower pressure exerted on the projectile, resulting in quite different ballistic characteristics.

Moreover, due to the explosive "burn" of black powder, the gas pressure and the projectile velocity reach a maximum at a point ahead of the muzzle end of the barrel, while the gas pressure which results from smokeless powder produces an increasing velocity of the projectile as it travels through the barrel until it leaves the barrel. As a result, with black powder, the projectile tends to be coasting before it leaves the barrel, and any reduction in friction in the barrel would increase the muzzle velocity, but simply by reducing the drag on the projectile. However, increased barrel lengths produce greater accuracy, and thus there must be a compromise between accuracy and projectile velocity (or force) in the case of black powder firearms.

The increasing velocity of projectiles which are fired from smokeless powder, however, is a result of the controlled burn of the powder resulting in steadily increasing gas pressure (and velocity) until the projectile leaves the gun barrel. Thus, the use of smokeless powder produces both greater velocity and greater accuracy, since longer barrels may be used without sacrificing accuracy for force.

However, as a result of this controlled burning, there usually exists some powder still burning at the point when the projectile leaves the barrel, and the burning of this powder outside the muzzle end of the barrel produces a flash of light shortly beyond the end of the barrel. This flash of light is undesirable in some circumstances, and gives rise to the need for a flash suppressor or flash hider for use in firearms using modern, smokeless powder.

A flash suppressor is, however, by its very nature rather different from a noise suppressor or silencer. An attachment for reducing noise is similar in nature to a muffler which has baffles and chambers to reduce the noise of gasses passing through the device. When such noise suppressors are used on rifles, however, they greatly reduce the velocity of the bullet emerging from the barrel and also the accuracy of the gun to which they are attached. Thus such silencers are unsuited for use on rifles and the like for longer range shooting where accuracy becomes more critical.

Flash suppressors, however, must be capable of use on rifles used for long range shooting without hampering the accuracy of the gun.

Accordingly, a primary object of the present invention is to provide an improved flash suppressor for use with rifled gun barrels.

Another object of the present invention is to provide a flash hider for gun barrels which does not deleteriously affect the accuracy of the firearm.

A further object of this invention is to provide a flash suppressor capable of reducing the visibility of the muzzle flash of a firearm on the order of 40–50% and more over conventional flash suppressors in use.

Still another object of the invention is to provide a flash suppressor which actually improves the ballistic characteristics of the projectile after it leaves the muzzle end of the gun while still providing the greatly enhanced suppression of the muzzle flash.

Yet a further object of the present invention is to provide a flash suppressor which may be used with a variety of different calibers of firearms with similarly improved results.

Yet another object of this invention is to provide an improved flash suppressor which improves the muzzle velocity and the accuracy of the gun while still significantly reducing the muzzle flash.

These and other objects of the invention will become apparent when considered in light of the following specification and claims, when taken together with the accompanying drawings.

BRIEF DESCRIPTION OF THE INVENTION

Figure 1:
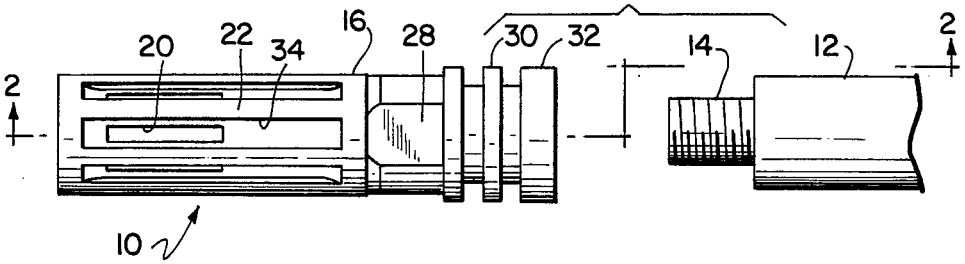
FIG. 1 is a side elevation view of one embodiment of a flash suppressor according to the present invention.

The flash suppressor of the present invention is adapted for attachment to a conventional rifled gun barrel of standard calibers. Such gun barrels are often provided on their muzzle ends with threaded ends for attachment of flash suppressors, silencers, sights, and the like, and the suppresors of this invention are provided with a correspondingly threaded portion to facilitate such attachment.

The flash suppressor comprises a cylindrical body having a first portion immediately adjacent the end of the rifled barrel, and a second portion extending from the first portion to the discharge end of the suppressor.

The first portion consists of a length of a smooth bore (i.e., not rifled) of a specified constant internal diameter. The diameter of the smooth bore portion is a function of the caliber of the gun, as will be described shortly. The second portion is of a greater internal diameter than the first portion, and is also provided with a plurality of longitudinal extending, radially directed vents openings to the outside of the body from the internal bore.

In a conventional rifled barrel, the barrel has a bore diameter of a given dimension, and has rifling grooves formed therein to a depth such that a circle passing through the bottom of the rifling grooves is slightly greater in diameter than the bore diameter. For example, the bore diameter of a .223 caliber rifle barrel is 0.2190 inch, while the depth of the grooves is such that the diameter of a circle passing the bottom of the grooves would be 0.2240 inch. In other words, the grooves have a depth of 0.0025 inch, i.e. one half of the difference between the bore diameter and the groove diameter.

For such a rifle, the bullet has an initial diameter of 0.2240 inch, and thus as the bullet passes through the barrel it is reduced slightly in diameter in the area of the bore and it is elongated slightly as it passes through the barrel.

According to the present invention, the first portion of the suppressor body, i.e. the smooth bore passage, has an internal diameter slightly less than the groove diameter of the rifling grooves, and preferably between that of the bore diameter of the barrel and the groove diameter. The effect of this is to further elongate the bullet and squeeze it down and also to provide a further burn time, and thus greater acceleration time for the bullet.

The second portion of the suppressor body is of an inside diameter significantly greater than the smooth bore (or first) portion so that the bullet can not contact the inside of this second portion. The enlarged inside diameter of this second portion permits an expansion of the gasses, and the vents provided in the second portion of the cylindrical body permit the escape of unburned gasses without ignition thereof or with reduced ignition or "flash."

Preferably the first portion, i.e. the smooth bore portion of the suppressor has a diameter of 0.0006 to 0.0008 inch less than the diameter of a circle passing through the bottom of the rifling grooves, as this has been found to provide the optimum effect and to allow for improved thermal expansion of the bullet. The length of the smooth bore portion of the suppressor body is not particularly critical, and is more a function of the additional length permissible for a given rifle. However, generally it has been found that each one inch length of this first, or smooth bore, portion of the body provides an increase of 25–35 feet per second (fps) in the muzzle velocity, up to the limit of the amount of powder in the cartridge.

In the case of the .223 caliber example above, the optimum length of the smooth bore portion of the suppressor has been found to be 1.687 inch, allowing for a significant increase in the velocity of the bullet, a more complete burn of the powder, and by virtue of the more complete burn of the powder and gasses a reduced possibility for flash at the muzzle end due to ignition of unburned gasses.

The second portion of the body of the suppressor, as indicated above, is provided with a plurality of radially directed, longitudinally extending vents. The vents are formed in a portion of the cylindrical body in which the internal diameter is significantly greater than the internal diameter of the first portion, so that the bullet cannot contact the inside wall of this second portion, while the outside diameter is substantially the same as the outside diameter of the first portion. In the case of the same example of a .223 caliber gun, the inside diameter of the slotted portion of the suppressor would be about one-half inch.

The vents are in the nature of slots cut into the body through the wall thereof. The inside wall of the second portion terminates in an outwardly flared end permitting still further expansion of the gas prior to complete release.

The vents also form a series of longitudinally extending ribs or flutes between the vent openings. In one embodiment, these ribs extend longitudinally a distance greater than the length of the vent opening, and thereby extend toward the gun barrel over a portion of the smooth bore section formed on the inside of the body. In this manner, the ribs may act as fins to dissipate heat from the suppressor body.

The number of vents (and thus the number of fins) is a function of the caliber of the gun upon which the suppressor is to be used, and thus the diameter of the body of the suppressor, since larger caliber guns (having larger diameter barrels) will permit use of more vents (and fins.) Generally speaking, the vent slots and the fins should each have thicknesses of about three-sixteenths inch to about one-eighth inch.

The body of the suppressor may also be provided with means for facilitating the threaded attachment of the body to the barrel, such as flats for engagement by a wrench of blind holes for use with a suitable spanner-type wrench. In addition, means may be provided for securing the suppressor body onto the end of the barrel, such as a pin passing chordally through the threaded portion of the barrel/suppressor junction, or by means of set screws passing radially through the body of the suppressor and engaging the threaded extending portion of the barrel.

The foregoing dimensions are set forth merely by way of example with respect to a particular caliber of gun, and the invention is not limited to this caliber. The principles of the invention are equally applicable to other calibers by following the principles and teachings set forth herein.

DESCRIPTION OF THE PREFERRED EMBODIMENTS

Figure 2:
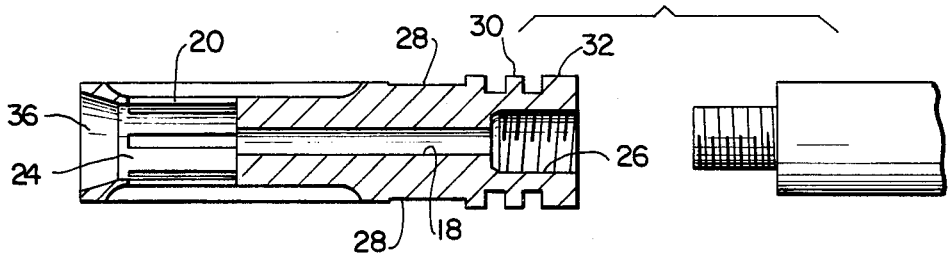
FIG. 2 is a longitudinal cross sectional view along lines 2—2 of FIG. 1 and viewed in the direction of the arrows.

Referring firstly to the embodiment of FIGS. 1 and 2 there is seen a flash suppressor generally designated 10 removed from a gun barrel 12. The barrel 12 is provided with an externally threaded end portion 14.

The flash suppressor 10 comprises a generally cylindrical body 16 having a first portion with an internal smooth bore 18 and a second portion provided with longitudinally extending, radially directed vent slots 20 separated by vanes 22. The inside diameter of the counterbore 24 of the body in the area of the vent slots 20 is significantly greater than the diameter of the smooth bore portion 18, on the order of twice the diameter of the smooth bore portion 18.

The body 16 is provided with an internally threaded portion 26 corresponding to the threaded portion 14 of the barrel 12, in order that the suppressor may be threaded onto the barrel. To facilitate tightening of the suppressor 10, a pair of diametrically opposed flats 28 may be provided on the body 16, so that a wrench may be used to tighten the suppressor on the barrel.

The end of the smooth bore 18, adjacent the threaded portion 26, may be slightly chamfered to facilitate entry of the projectile into the bore 18. Because of the dimensions involved, this chamfering is very slight, and not able to be seen in the drawing.

The external surface of the body 16 may also be provided with a ring 30 for mounting a blank firing device, and a bayonet mounting ring 32 for the addition of suitable attachments such as sighting devices or bayonets in a conventional manner.

The vanes 22 are formed in the body 16 by cutting slots 34 therein in such a manner as to provide the desired number of slots 20 and vanes 22. The slots and the vanes should be of a width on the order of one-eighth inch to three-sixteenths inch, and following this dimension, the number of slots (and vanes) will be determined according to the external diameter of the body 16. For a .223 caliber rifle, eight vents and eight flutes have been found to be the preferred number of slots and flutes.

The bore 24 preferably terminates in an outwardly flared portion 36 at the distal end of the body 16.

Figure 9:
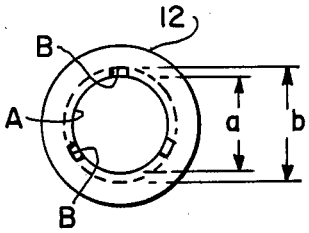
FIG. 9 is an enlarged cross sectional schematic of a gun barrel.
Figure 3:
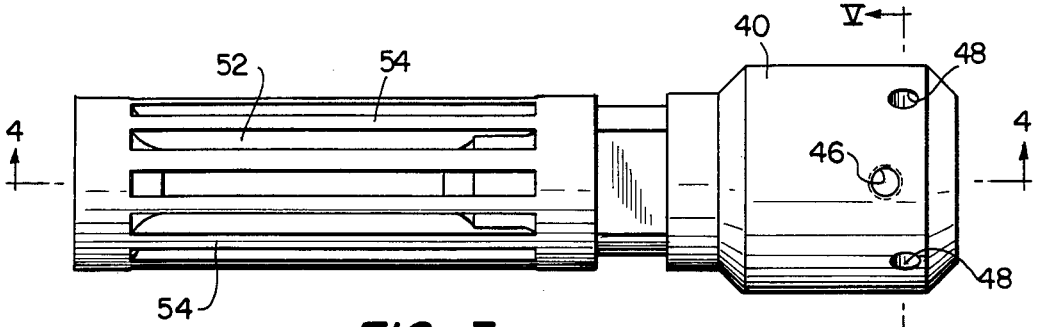
FIG. 3 is a side elevation view of another embodiment of a flash suppressor of the present invention.
Figure 4:
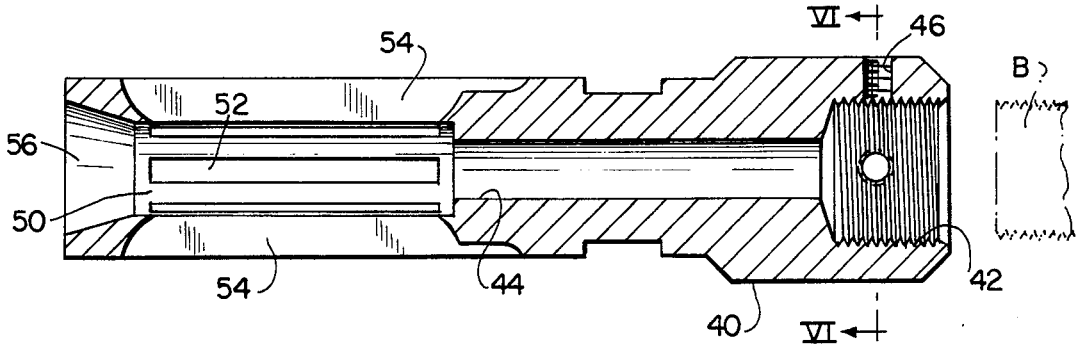
FIG. 4 is a longitudinal cross sectional view along lines 4—4 of FIG. 3 and viewed in the direction of the arrows.
Figure 5:
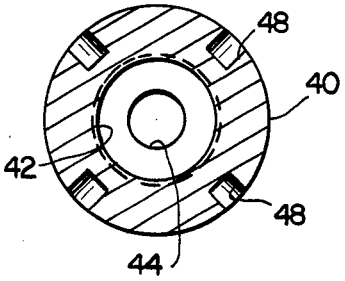
FIG. 5 is a sectional view taken along lines V—V of FIG. 3 and viewed in the direction of the arrows.
Figure 6:
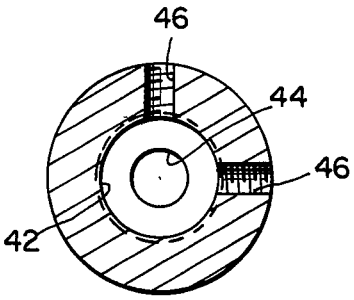
FIG. 6 is a sectional view taken along lines VI—VI of FIG. 4 and viewed in the direction of the arrows.

As depicted in FIG. 9, a gun barrel 12 has an internal bore A and is provided on its inside surface with a plurality of spirally arranged rifling grooves B. The diameter of the bore A is thus given by "a". The bottoms of the grooves B lie on a circle whose diameter is given by "b". Accordingly, the inside diameter "SB" of the smooth bore 18 of the flash suppressor 10 is thus given by the expression $b > SB$, and preferably $b > SB > a$.

In the preferred instance, the diameter of the smooth bore portion 18 of the suppressor would be given by the expressions $SB = b - (0.0006 \text{ inch to } 0.0008 \text{ inch})$ and $SB > a$.

When these relationships are met, the projectile will be squeezed down in diameter and elongated when it passes into the smooth bore portion 18, and the continued burn of the powder and gasses will result in increased acceleration as the bullet passes through the bore 18.

When the bullet enters the bore 24, it will be free of contact with the barrel or the flash suppressor. When the bullet exits the bore 18, the gasses behind it are free to expand in the area of the counterbore 24 and escape through the vent slots 20. Since the gasses have been allowed to expand, and thus cool slightly, there is less opportunity for the gasses to ignite upon release.

FIGS. 3 through 6 show another slightly different embodiment of the invention. Here, the body 40 also has a threaded internal bore 42 at one end for attachment to a rifled barrel B. The threaded bore 42 leads to a smooth bore portion 44. A pair of radially directed, threaded holes 46 as provided and pass into the bore 42. The holes 46 are adapted to receive set screws which may be tightened against the barrel B in order to secure the flash suppressor on the end of the barrel.

A plurality of blind holes 48 are also provided in the outside surface of the body 40 for engagement by a suitable spanner wrench (not shown) in order to tighten the suppressor onto the barrel B.

As in the previous embodiment, the smooth bore 44 opens into a counterbore 50 of greater diameter. The counterbore area of the suppressor is provided with a plurality of vent openings 52 which are separated by vanes or fins 54.

And its distal end, the counterbore 50 has an outwardly flared end portion 56.

Again, the diameter of the smooth bore portion 44 must be greater than the diameter of the bore of the rifle barrel B, but less than the diameter of a circle passing through the bottom of the rifling grooves, as in the previous embodiment.

Figure 7:
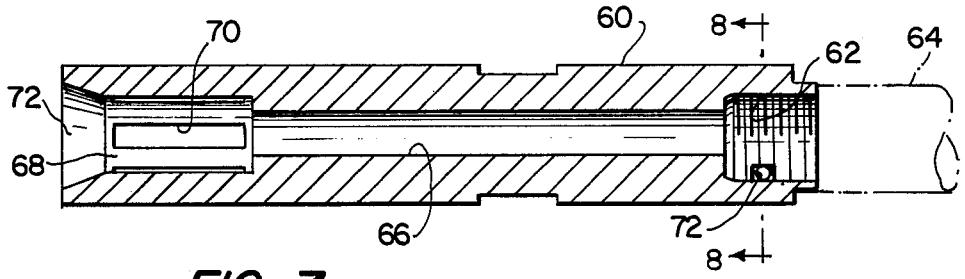
FIG. 7 is a longitudinal sectional view of another embodiment of a flash suppressor according to the present invention.
Figure 8:
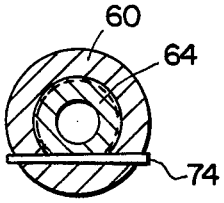
FIG. 8 is a sectional view taken along lines 8—8 of FIG. 7 and viewed in the direction of the arrows.

FIGS. 7 and 8 show another embodiment of a flash suppressor according to the present invention, again where the body 60 of the suppressor is provided with an internally threaded portion 62 at one end for threaded engagement with the end of a rifle barrel 64. A smooth bore passage 66 extends longitudinally through the body 60 and opens into a counterbore 68 of significantly greater diameter.

The counterbore 68 is provided with a plurality of vent openings 70, and a flared distal end portion 72.

In order to secure the flash suppressor 60 onto the barrel 64, a chordally arranged hole 72 is drilled so as to pass through the junction of the threads on the barrel 64 and on the suppressor 60. A tapered pin 74 may then be driven into the hole 72, thus securing the two parts against rotation such as would disassemble the suppressor and the barrel.

Visual observation of the flash produced by an M16A1 rifle of .223 caliber, firing 5.56 mm A071 ball ammunition gives the impression that the flash is much less than that produced by the same rifle with a standard suppressor. To confirm this observation, the muzzle flash was recorded photographically, and the results were analyzed with a densitometer.

The results of the densitometer readings were adjusted such that pure black would register 100 density units (du) and pure white would register 0 du. The following table shows a comparison of the flash obtained from the foregoing rifle using a standard flash suppressor and the improved suppressor according to the present invention.

TABLE

| | Standard | Invention | Difference |
|---|---|---|---|
| Actual Muzzle | 44 du | 88 du | 44 du |
| Top Vane | 61 | 95 | 34 |
| Middle Vane | 48 | 95 | 47 |
| Bottom Vane | 63 | 93 | 30 |
| Top Flare | NA | 94–92 | NA |
| Middle Flare | NA | 92–90 | NA |
| Bottom Flare | NA | 94–89 | NA |
| Muzzle Flash Average | 86.6 | 73.2 | 13.4 |

In density unit measurement, 30 du represents a difference of 50% in density. Thus, the average vane flash reduction produced by the present invention was 38.5 du, or better than a 50% reduction in vane flash. Further, while the muzzle flash appears to have increased, the flash produced by the suppressor of the present invention was reddish in color compared to the yellow flash of the standard suppressor, and thus is far less visible to the eye. In addition, the flash of the rifle using the suppressor according to the present invention was 60% smaller than the flash emitted by the standard suppressor.

The overall reduction in the flash of the suppressor of this invention compared to the prior art was 41–46%.

Thus, the flash suppressor of this invention is highly effective in reducing vane and muzzle flash.

Other tests have been conducted to compare the velocity and accuracy of ammunition fired using both a prior art type flash suppressor and a suppressor according to the present invention. One such test used a standard M-16 top receiver, .223 caliber rifle, with ammunition loaded with M-193 Winchester bullets and Winchester ball powder at 55 grains.

The barrel of the rifle had a 1 in 12" twist and open sights. The rifle was fired at a target at 50' distance, with instrument distances of 5' and 10'.

Using the prior art flash suppressor, a 10 shot test showed recorded velocities ranging from 3,053 feet per second (fps) to 3,196 fps, with an average velocity of 3,109 fps and a standard deviation of 46. The shots produced a group of 2¼ inch by 1¾ inch.

With the flash suppressor according to FIGS. 1 and 2 of this application, using the same rifle and the same ammunition, fired by the same tester and the same test instrument, the measured velocities for a 10 shot test ranged from a low of 3,153 fps to a high of 3,203 fps and an average of 3,173 with a standard deviation of 14. The 10 shot group measured 1¼ inch by 1 inch.

A similar test was conducted using a .308 caliber Winchester rifle. With the prior art flash suppressor, the bullet velocity ranged from a low of 2,742 fps to a high of 2,811 fps and an average velocity of 2778 fps and a standard deviation of 34. The ten shots produced a group measuring 3¾ inch by 3¼ inch.

After switching to a flash suppressor according to the present invention, the 10 shots ranged in velocity from a low of 2,868 fps to a high of 2,885 fps with an average of 2,878 fps and a standard deviation of 7. The ten shots were in a group measuring 2½ inch by 2 inch.

Thus, the flash suppressor according to the present invention produced markedly superior results in comparison to the prior art flash suppressor.

While this invention has been described as having certain preferred features and embodiments, it will be apparent that it is capable of still further modification, and this application is intended to cover all modifications, variations and adaptations of the invention which fall within the spirit of the invention and the scope of the appended claims.

I claim:

1. A flash suppressor for use on a rifled barrel of a firearm comprising a generally cylindrical body member having a first portion adapted to receive a projectile from said barrel and a second portion adapted to receive a projectile from said first portion, said first portion having a longitudinal smoothbore passage therethrough through which a projectile discharged from said barrel passes, and said smoothbore passage having a diameter less than the diameter of a circle passing through the bottom of the rifling grooves in said barrel, said second portion having an inside diameter significantly greater than the diameter of said smoothbore passage, and a plurality of radially directed vent openings formed in said second portion of said body member.

2. A flash suppressor as in claim 1 and wherein the diameter of said smoothbore passage is greater than the bore diameter of said barrel.

3. A flash suppressor as in claim 2 and including means for attaching said flash suppressor to said barrel.

4. A flash suppressor as in claim 3 and including means for securing said flash suppressor on said barrel.

5. A flash suppressor as in claim 4 and wherein said attaching means comprises cooperating threaded portions on said body member and said barrel.

6. A flash suppressor as in claim 5 and wherein said securing means comprises set screw means.

7. A flash suppressor as in claim 5 and wherein said securing means comprises a pin member passing through said body member and said barrel.

8. A flash suppressor as in claim 1 and wherein the diameter of said smoothbore passage is about 0.0006 inch to about 0.0008 inch less than the diameter of said circle.

9. A flash suppressor as in claim 1 and wherein said vents extend longitudinally in the wall of said second portion.

10. A flash suppressor as in claim 9 and wherein said vents are separated by a plurality of longitudinally extending flutes.

11. A flash suppressor as in claim 10 and wherein said flutes are of a length greater than said vents so as to extend along a part of the exterior of said first portion.

12. A flash suppressor as in claim 5 and wherein said body member includes portions adapted to be engaged by a wrench for tightening said suppressor on a barrel.

13. A flash suppressor for attachment to a firearm barrel having rifling grooves formed therein and wherein the barrel has a bore diameter "a" and the bottom of the rifling grooves lie substantially on a circle of a diameter "b", said flash suppressor comprising a generally cylindrical body member comprising a first portion adjacent the end of said barrel and having a smoothbore passage free of rifling grooves coaxial with the bore of said barrel, said body member further including a second portion substantially coaxial with said smoothbore passage and the bore of said barrel, said second portion having an inside diameter substantially greater than the diameter of said smoothbore passage, a plurality of longitudinally extending, radially directed vent openings formed in the wall of said second portion, and wherein the diameter "SB" of said smoothbore passage satisfies the expression $b > SB$.

14. A flash suppressor as in claim 13 and wherein the diameter of said smoothbore portion satisfies the expression $b > SB > a$.

* * * * *